United States Patent [19]

Sonntag et al.

[11] Patent Number: 4,849,684

[45] Date of Patent: Jul. 18, 1989

[54] CMOS BANDGAP VOLTAGE REFERENCE APPARATUS AND METHOD

[75] Inventors: Jeffrey L. Sonntag, Rockland Township, Berks County; Thayamkulangara R. Viswanathan, Wyomissing Hills, both of Pa.

[73] Assignee: American Telephone and Telegraph Company, AT&T Bell Laaboratories, Murray Hill, N.J.

[21] Appl. No.: 267,957

[22] Filed: Nov. 7, 1988

[51] Int. Cl.[4] ..... G05F 3/30

[52] U.S. Cl. ..... 323/313; 323/907

[58] Field of Search ..... 323/313, 314, 907

[56] References Cited

U.S. PATENT DOCUMENTS

| | | | |
|---|---|---|---|
| 4,249,122 | 2/1981 | Widlar | 323/313 |
| 4,349,778 | 9/1982 | Davis | 323/314 |
| 4,588,941 | 5/1986 | Kerth et al. | 323/314 |
| 4,626,770 | 12/1986 | Price | 323/313 |
| 4,628,248 | 12/1986 | Birittella et al. | 323/314 |
| 4,672,304 | 6/1987 | Degrauwe et al. | 323/314 |
| 4,795,918 | 1/1989 | Menon et al. | 323/313 |

OTHER PUBLICATIONS

"A Low-Voltage CMOS Bandgap Reference", IEEE Journal of Solid-State Circuits, vol. SC-14, No. 3, Jun. 1979, Eric A. Vittoz, Member IEEE and Olivier Neyroud, pp. 573 through 577.

"Analysis and Design of Analog Integrated Circuits", Second Edition, Paul R. Gray, Robert G. Meyer, University of California, Berkeley, Published by John Wiley & Sons, Inc., Copyright 1977, 1984, pp. 733 through 737.

*Primary Examiner*—William H. Beha, Jr.

*Attorney, Agent, or Firm*—Scott W. McLellan

[57] ABSTRACT

An improved CMOS bandgap voltage reference in which a magnified current derived from a thermal voltage reference produces a voltage drop across a resistor. The resistor in turn couples to a single bipolar transistor which is part of the thermal voltage reference. The bandgap voltage is the sum of the voltage across the resistor and the voltage across the bipolar transistor. In addition, the immunity of a bandgap voltage reference to variations in power supply variations is improved by having a differential amplifier sense the voltages at the control current input and the output of a current mirror in the thermal voltage reference portion of the bandgap voltage reference and adjusting the power supply voltage to the thermal voltage reference until the sensed voltages are substantially the same.

10 Claims, 2 Drawing Sheets

$V_{BG}$
$V_B$
$I_{PTAT}$
$I_{N2}$
N2
$V_{BE}$
$V_A$
N1
$I_{N1}$
$V_t$
$V_{DD}$
N3
$V_{SS}$
10
11
20
21
22
23
24
25
25n
26
27
28
29
30
31
32
33
34
35
36
38
39
40

200

CMOS BANDGAP VOLTAGE REFERENCE APPARATUS AND METHOD

FIELD OF THE INVENTION

This invention relates to voltage references, and more particularly, to bandgap voltage references implemented in complementary metal-oxide-silicon integrated circuit technology.

BACKGROUND OF THE INVENTION

A stable voltage reference immune to temperature and power supply variations is required for high performance analog components produced today. For example, the conversion accuracy of signals from analog to digital and back again in precision coders/decoders (CODECS) is directly dependent on the accuracy of an internal reference. Typically the internal reference is a voltage reference which must be tolerant of power supply voltage variations and noise as well as temperature variations. To keep the cost of CODECS as low as possible, the internal reference should be as physically small as possible and allow for precision trimming of the output voltage, $V_{BG}$, if necessary.

A common solution to the internal voltage reference requirement is a circuit known as a bandgap voltage reference. Ideal bandgap voltage references have a predetermined output voltage substantially invariant with variations in temperature by combining the positive temperature coefficient of a thermal voltage ($V_T$ or kxT/q, discussed below), generated by differing voltage drops across forward-biased PN junctions at different current densities, with the negative temperature coefficient of the voltage drop across a forward-biased PN junction ($V_{BE}$). In practice, by adding a multiplied thermal voltage, $V_T$, to $V_{BE}$, an output voltage with a predetermined temperature coefficient can be created. Typically, the predetermined temperature coefficient is chosen to be substantially zero.

An exemplary bandgap voltage reference of the prior art is shown in FIG. 2. This simplified bandgap reference 200 is susceptible to power supply voltage ($V_{DD}$) variations and noise. A more elaborate variation of this bandgap reference having less susceptibility to power supply voltage variations is discussed in "Analysis and Design of Analog Integrated Circuits", second edition, by P.R. Gray and R.G. Meyer, 1984, pp. 733–737. In FIG. 2, a voltage $V_t$, which is proportional to $V_T$, is generated across resistor 201. The temperature coefficient of $V_t$ is also proportional to $V_T$ and is scaled as $V_t$ is scaled to $V_T$. As will be discussed in more detail in the Detailed Description, below, if each bipolar transistor $203_1$–$203_n$ is substantially identical to bipolar transistor 202 and substantially identical current flows into transistor 202 as into combined transistors $203_1$–$203_n$, then the current density in transistor 202 is n-times that in each transistor $203_1$–$203_n$. The differing current density results in a different voltage drop across transistor 202 than across transistors $203_1$–$203_n$. The difference in voltage drops, designated here as $V_t$, is forced to appear across resistor 201. To do so, the voltage on the emitter of transistor 202 (node N) must be the same as the voltage on nodeN'. To make the voltage on nodes N and N' the same, fieldeffect transistors (FETs) 204, 205 form a current mirror (not numbered) and FETS 206, 207 form a regulator means (not numbered) which, when coupled to the current mirror, maintains equal output voltages on the source terminals of FETs 206, 207 coupling to nodes N and N', respectively. If FET 206 and FET 207 are the same size with equal current flowing through them from corresponding FETs 204, 205, the gate-to-source voltages of FETs 206, 207 will be the same, resulting in identical voltages on nodes N, N', the outputs of the regulator means. Hence, the difference in the voltage drops across transistors 202 and transistors $203_1$–$203_n$, $V_t$, appears across resistor 201.

Since the voltage $V_t$ is dropped across resistor 201, the current through resistor 201, $i_t$, corresponds to the thermal voltage $V_T$ and has the same temperature coefficient as $V_t$ less the temperature coefficient of resistor 201. More particularly, the temperature coefficient of the current $i_t$ has the temperature coefficient of $V_t$ less the temperature coefficient of resistor 201. In practice, the temperature coefficient of the resistor 201 is much less than the temperature coefficient of $V_t$. FET 208, responsive to FET 205, mirrors current $i_t$ to produce current $I_t$. Current $I_t$ passes through resistor 209 to paralleled bipolar transistors $210_1$–$210_n$, which generate the forward PN junction voltage, $V_{BE}$. Transistors $210_1$–$210_n$ correspond to transistors $203_1$–$203_n$ and are substantially the same size. The voltage $V_{BE}$ adds with the voltage drop across resistor 209 in response to the current $I_t$, resulting in the bandgap voltage $V_{BG}$ approximately equaling:

$$V_{BG}=V_{BE}+(R_{209}/R_{201})\times V_T\times \ln(n);$$

where $R_{201}$, $R_{209}$ are the resistances of resistors 201, 209, respectively. The where $R_{201}$, $R_{209}$ pectiThe typcal resistance of resistor 209 is six times that of resistor 201, with resistor 209 consisting of six resistors in series, each resistor having the same resistance as resistor 201.

This bandgap voltage reference 200 suffers from large area requirements due to the 2n+1 bipolar transistors (transistors $203_1$–$203_n$ and $210_1$–$210_n$ and seven resistors (resistors 201 and 209) necessary for the proper generation of the $V_t$ and $V_{BE}$ voltages. Further, this arrangement suffers from low power supply noise immunity resulting from the FETs 206, 207 of the regulator means having different drain-to-source voltages: the drain voltage of FET 207 is the power supply voltage ($V_{DD}$) less a gate-to-source voltage ($\approx$1 volt) of FET 205, and the drain voltage of FET 206 is approximately 0.7 volts plus a gate-to-source voltage $V_{BG}$ ($\approx$1 volt). For a five volt power supply, the resulting approximate drain-to-source voltages are 3.3 volts for FET 204, 1 volt for FET 205, 1 volt for FET 206 and 3.3 volts for FET 207. The finite output resistances of the FETs 204, 205, 206, 207 with different drain-to-source voltages cause slight differences in current to flow through FETs 206, 207 and consequently, different voltages on the nodes N, N'. This difference in voltage deviates $V_t$ from the true voltage difference in voltage drops across transistor 202 and transistors $203_1$–$203_n$. Also, the accurate mirroring of the current $i_t$ by FET 208 is compromised by the finite output resistance thereof. The inaccuracy of current mirroring FETs 206, 207, 208 degrades the performance of the bandgap voltage reference by deviating the output voltage $V_{BG}$, and the desired temperature coefficient thereof, from what is desired. The differences in current through FETs 206, 207 and the inaccurate current mirroring by FET 208 are dependent on the power supply voltage $V_{DD}$. As disclosed on page 735 of the above-identified reference, the current mirror is compounded and the FETs 206,

207 are made as large as possible to reduce the output resistances thereof in an attempt to reduce the effect the power supply voltage has on the reference. However, different drain-to-source voltages on the FETs remain and, consequently, the immunity of the reference to power supply voltage variations still suffers. Another undesirable result of compounding the current mirrors limits the required power supply voltage ($V_{DD}$) to greater than five volts, a common power supply voltage used in integrated circuits.

SUMMARY OF THE INVENTION

A new bandgap voltage reference has been invented which requires considerably smaller chip area than bandgap voltage references of the prior art. Further, the output voltage of the new bandgap voltage reference can be easily trimmed for a precision output voltage independent of resistors used therein. This has been achieved generally by having a thermal voltage reference including at least one current mirror having a control current input and output; a regulator means, coupled to the control current input and the output of the current mirror, for providing at least two outputs with substantially the same voltages thereon; a first bipolar transistor coupled to a first one of the outputs of the regulator means; and a plurality of paralleled bipolar transistors coupled to a second one of the outputs of the regulator means through a first resistor; a means, responsive to at least one of the current mirrors, for generating a current to an output node, the current being proportional to current passing through the current mirror; and a second resistor, coupling between the output node and the first bipolar transistor, for generating a voltage proportional to the current from the means. With the output current from the means being proportional to temperature and the bipolar transistors being all of substantially the same size, the voltage on the output node is the output voltage from the bandgap voltage reference and is the sum of the voltage across the second resistor and a voltage developed from the first bipolar transistor.

Further, a means and method for reducing the sensitivity of a bandgap voltage reference to variations in the power supply voltage has been invented. This result has been achieved generally by having a differential amplifier for sensing voltages where a current mirror and a regulator means couple together in the thermal voltage reference portion of the bandgap reference, and a variable voltage power source, responsive to the differential amplifier, for powering the bandgap voltage reference. The voltage from the variable voltage power source is varied in response to the differential amplifier until the sensed voltages are substantially equal.

BRIEF DESCRIPTION OF THE DRAWING

The foregoing features of this invention, as well as the invention itself, may be more fully understood from the following detailed description of the drawings, in which.

DETAILED DESCRIPTION

Figure 1:
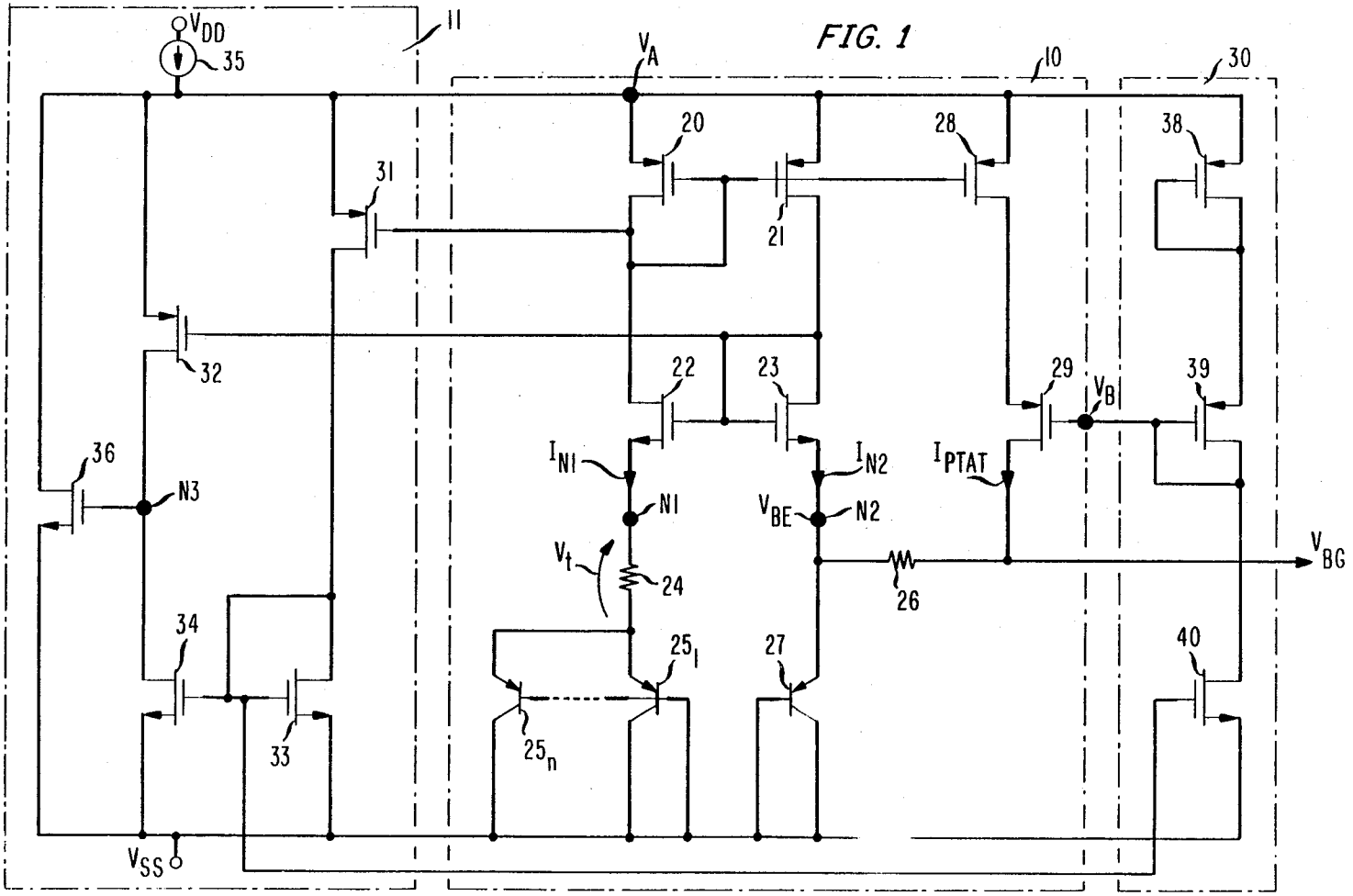
FIG. 1 is a schematic diagram of the improved CMOS bandgap voltage reference with a voltage preregulator in accordance with one embodiment of the invention; and, FIG. 2 is a simplified schematic diagram of a bandgap voltage reference of the prior art.

Referring to FIG. 1, the improved bandgap voltage reference 10 and voltage regulator 11 are shown in schematic form. The voltage regulator 11 will be discussed in more detail below, but it is sufficient to state here that the regulator 11 provides a predetermined voltage $V_A$ derived from the power supply $V_{DD}$ to power the bandgap voltage reference 10. It is noted here that the designations $V_{DD}$ and $V_A$ refer to power sources and the voltages thereof and may be used interchangeably.

Figure 2:
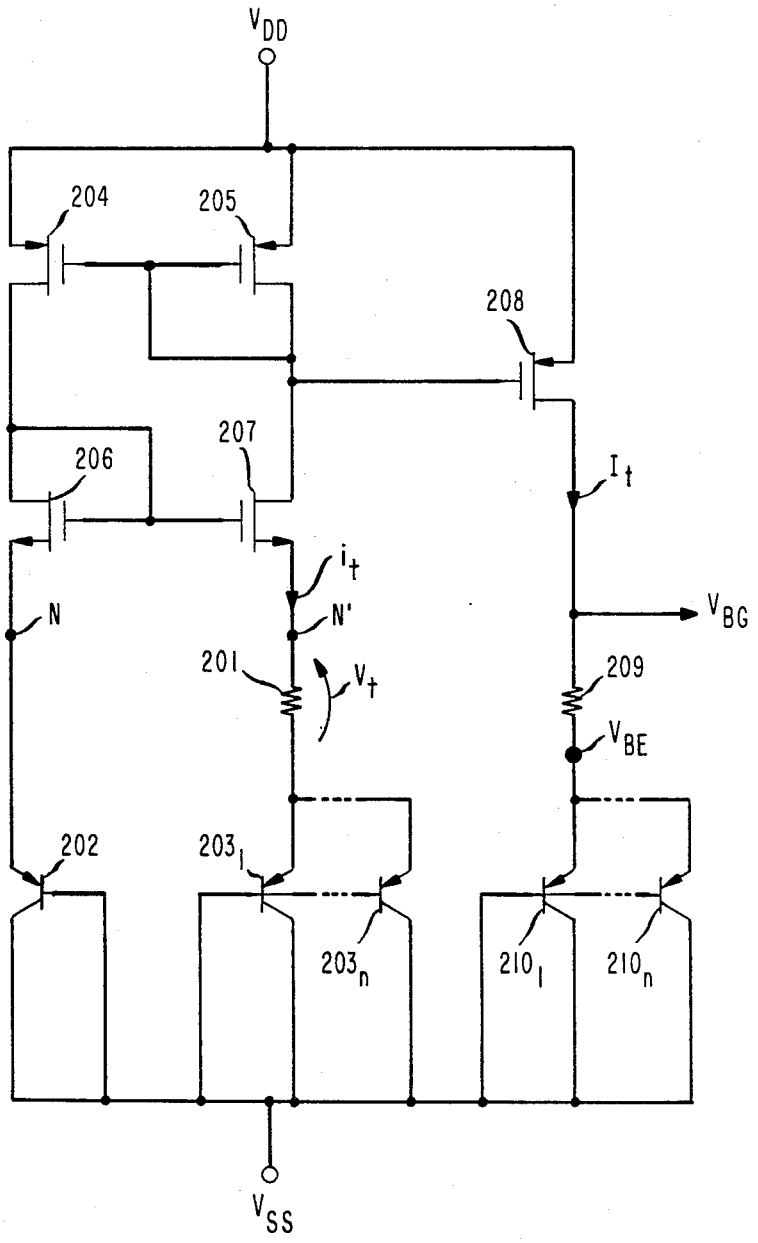
FIG. 2 (PRIOR ART)

The bandgap voltage reference 10 has a first current mirror (FETs 20, 21) driving a regulator means (FETs 22, 23) to supply currents $I_{N1}$, $I_{N2}$ to nodes N1 and N2, respectively. FET 20 is substantially matched to FET 21 and FET 22 is substantially matched to FET 23 so that currents $I_{N1}$ and $I_{N2}$ are, for purposes here, substantially equal. Further, by having substantially equal currents $I_N$ and $I_{N2}$, and with FET 22 substantially the same as FET 23, the gate-to-source voltages for FETs 22, 23 are substantially the same. Hence the voltages on nodes N1 and N2 are substantially the same and form the outputs of regulator means. Current from node N1 ($I_{N1}$) passes through resistor 24 and bipolar transistors $25_1$–$25_n$, whereas current from node N2 ($I_{N2}$) and from resistor 26 ($I_{PTAT}$) together passes through bipolar transistor 27. For the moment neglecting the current contribution to node N2 from resistor 26 ($I_{PTAT}$), which will be discussed in more detail below, and noting that the electrical characteristics and temperatures of transistor 27 and each of the transistors $25_1$–$25_n$ are substantially identical, a voltage, $V_t$, is dropped across resistor 24 which is proportional to the thermal voltage, $V_T$. As discussed above in connection with the bandgap reference of the prior art (FIG. 2), due to substantially equal voltages on nodes N1, N2 and a different current density in each of transistors $25_1$–$25_n$ from that in transistor 27 resulting from, for purposes here, essentially identical current flowing in transistor 27 and through the combined transistors $25_1$–$25_n$, the voltage $V_t$, across resistor 24 is given by the equation:

$$V_t = V_T \times \ln(n);$$

where n is the number of transistors $25_1$–$25_n$. Recognizing that:

$$V_T = k \times T/q;$$

where k is Boltzmann's constant ($1.3805 \times 10^{-23}$ J/°K), T is the temperature in degrees Kelvin, q is the electrical charge of an electron ($1.6021 \times 10^{-19}$ C). It is noted that the thermal voltage $V_t$ is proportional to absolute temperature, i.e., it has a positive linear temperature coefficient, hence $V_t$ is also proportional to absolute temperature. It therefore follows that the current $I_{N1}$, through resistor 24, is also dependent on absolute temperature. More particularly, the temperature coefficient of the current $I_{N1}$ has the temperature coefficient of $V_t$ less the temperature coefficient of resistor 24. In practice, the temperature coefficient of the resistor 24 is much less than the temperature coefficient of $V_t$. Further, since the current mirrors (FETs 20, 21, 22, 23) assure that the current $I_{N1}$ is substantially the same as the current $I_{N2}$, the current $I_{N2}$ is also dependent on absolute temperature:

$$I_{N1} = I_{N2} = V_t/R_{24};$$

where $R_{24}$ is the resistance of resistor 24.

When including the current into node N2 from resistor 26, $I_{PTAT}$, $V_t$ then becomes:

$$V_t = V_T \times \ln(n \times (1 + I_{PTAT}/I_{N1}));$$

so that:

$$I_{N1} = I_{N2} = (V_T/R_{24}) \times \ln(n \times (1 + I_{PTAT}/I_{N1})).$$

FET 28 proportionally mirrors the current $I_{N1}$ through cascode connected FET 29 to produce current $I_{PTAT}$. The size of FET 28 is M times the size of FETs 20 or 21, magnifying the current $I_{N1}$ by a factor of M. FET 29, being cascode connected with FET 28, assists in the accurate magnification of the current $I_{N1}$. The gate of FET 29 is coupled to a bias voltage generator 30 providing a bias voltage, $V_B$. Bias voltage generator 30 will be discussed in more detail below, but it sufficient to state here that the voltage $V_B$ is chosen so that the voltage on the drain of FET 28 is substantially the same as the voltage on the drains of FETs 20, 22 to improve the accuracy of the magnification of the current $I_{N1}$ by FETs 28, 29. Since $I_{PTAT}/I_{N1} = M$, then:

$$I_{PTAT} = M \times (V_T/R_{24}) \times \ln(n \times (1 + M)).$$

The current $I_{PTAT}$ passes through resistor 26 to generate a voltage equal to the product of the resistance of resistor 26, referred to here as $R_{26}$, and the current $I_{PTAT}$. This voltage is added to the voltage across the transistor 27, $V_{BE}$, discussed above, to develop the bandgap reference voltage $V_{BG}$:

$$V_{BG} = V_{BE} + I_{PTAT} \times R_{26}.$$

Substituting for the current term $I_{PTAT}$ the above, then:

$$V_{BG} = V_{BE} + M \times (R_{26}/R_{24}) \times V_T p \times \ln(nx(M+1)).$$

If $R_{24} = R_{26}$, then the effects of the resistors 24, 26 can be ignored, making the temperature coefficient of the bandgap voltage $V_{BG}$ virtually dependent only on the combined multiplied thermal voltage and the forward biased PN junction voltage $V_{BE}$. Using exemplary values of $M = 5$, $R_{24} = R_{26}$, $V_{BE} = 0.65$ volts and the exemplary values given above, $V_{BG}$ becomes approximately 1.15 volts with a practically zero temperature coefficient at room temperature. This bandgap voltage reference design has the advantage of allowing another degree of freedom to the designer over the bandgap voltage reference of the prior art (FIG. 2): the ability to set the contribution of the thermal reference to the bandgap output voltage by the current magnification factor M as well as scaling the resistance ratio of the resistors 24, 26. Hence with a one-to-one ratio of the resistances of resistors 24, 26, precision adjustments of the bandgap output voltage $V_{BG}$ can be easily done by trimming resistor 24 or resistor 26 until the desired output voltage is attained.

To reduce susceptibility of the bandgap voltage $V_{BG}$ with variations and noise in power supply voltage $V_{DD}$, voltage regulator 11 pre-regulates the power supply voltage $V_{DD}$ to generate $V_A$, thereby isolating the bandgap voltage reference from $V_{DD}$. $V_A$ is chosen such that the voltage on the drains of FETs 20, 22 is substantially the same as the voltage on the drains of FETs 21, 23. An additional advantage of pre-regulating $V_A$, so that the drain-to-source voltages of FET 20 and FET 21 are substantially the same (also making the drain-to-source voltages of FET 22 and FET 23 substantially the same), is that the currents $I_{N1}$ and $I_{N2}$ are better matched, improving the desired accuracy of the reference. FETs 31, 32 sense the difference between the voltage on the drains of FETs 20, 22 and that on the drains of FETs 21, 23. Further, as will be explained below, FETs 31, 32 are typically substantially the same size as corresponding FETs 20, 21. FETs 33, 34 mirrors current from FET 31 to combine with the current from FET 32 to node N3. The result is a differential amplifier, with a single-ended output on node N3, responsive to the difference in voltages at the interconnections of the current mirror of FETs 22, 23 and the regulator means of FETs 20, 21. Current source 35 supplies current exceeding the necessary current to power the shown circuits, and other circuitry (not shown) that requires the regulated voltage $V_A$, with the excess current diverted to $V_{SS}$ by FET 36. Although not shown here, current source 35 provides current proportional to the current necessary to power the bandgap reference by mirroring and magnifying the current through FET 33. FET 36 responds to the voltage on node N3, the output of the differential amplifier formed by FETs 31, 32, 33, 34. A closed loop is thereby formed which regulates the voltage $V_A$ by FET 36 shunting varying amounts of current from current source 35 to keep the drain-to-source voltages of FETs 22, 23 substantially the same. With exemplary threshold voltages $V_{th}$ of FETs 20, 21, 31, 32 of 1 volt, the voltage $V_A$ is approximately 3 volts. The regulation of voltage $V_A$ improves the overall performance of the bandgap voltage references by essentially eliminating deviations in the desired output voltage, $V_{BG}$, and the desired temperature coefficient thereof, due to inaccuracies in the mirroring and magnification of the currents $I_{NI}$, $I_{N2}$ into current $I_{PTAT}$.

Bias voltage generator 30 provides the proper bias voltage, $V_B$, to have the voltage on the drain of FET 28 substantially the same as voltage on the drains of FETs 20, 22 (and, consequently, the same voltage as on the drains of FETs 21, 23) to assure accurate magnification of the current $I_{N1}$. FETs 38 and 39 are diode-coupled to drop the voltage $V_A$ to the proper bias voltage $V_B$. By having the sizes of FETs 38, 39 substantially 1/M the sizes of corresponding FETs 28, 29 and with substantially the same current flowing through FETs 38, 39 as in FETs 20, 22, the voltage on the drain of FET 38 will be substantially equal to the voltage on the drains of FETs 20, 21. Consequently, because the size and current flowing through FET 28 is M times that of corresponding FET 39 and the voltage on the sources of FETs 29 and 39 are substantially the same, the gate-to-source voltage of FET 39 must then be the same as the gate-to-source voltage of FET 29, yielding the necessary bias voltage $V_B$.

To assure that the current flowing through FETs 38, 39 is substantially the same as the current flowing in FET 20, FET 40 mirrors the current flowing in FET 31. As stated above, the size of FET 31 is substantially the same as the size of FET 20. Having the size of FET 40 substantially the same size as FET 33 allows the current flowing in FET 40 to accurately mirror the current flowing in FET 20. Hence, the bias voltage $V_B$ from voltage generator 30 assures that the drain voltage of FET 28 is substantially the same voltage as on the drains of FETs 20, 22.

Although N- and P-channel FETs and PNP bipolar transistors are shown, it is understood that the N- and P-channel FETs can be interchanged and NPN bipolar transistors can be substituted for PNP transistors, with corresponding change in polarity of $V_{DD}$ and $V_{SS}$, with no significant change in the performance of the claimed bandgap voltage reference. Further, it is understood that NPN transistors can be used in place of the shown PNP transistors with the suitable reconfiguration of the transistors. In addition, although conventional current mirrors are shown, it is understood that other types of current mirrors could be substituted, such as Wilson current mirrors. It is also understood that scaling the size of a particular FET can be accomplished by simply enlarging the width of the FET. It is preferable, however, to achieve scaling by paralleling multiple FETs to achieve the desired size.

Having described the preferred embodiment of this invention, it will now be apparent to one of skill in the art that other embodiments incorporating its concept may be used. If is felt, therefore, that this invention should not be limited to the disclosed embodiment, but rather should be limited only by the spirit and scope of the appended claims.

What is claimed is:

1. A bandgap voltage reference providing an output voltage with a predetermined temperature coefficient, formed in an integrated circuit, and having a thermal voltage reference, the thermal voltage reference including: at least one current mirror having a control current input and an output; a regulator means, coupled to the control current input and the output of the current mirror, for providing at least two outputs with substantially the same voltage thereon; a first bipolar transistor coupled to a first one of the outputs of the regulator means; and a plurality of paralleled bipolar transistors coupled to a second one of the outputs of the regulator means through a first resistor, characterized by:

means, responsive to at least one of the current mirrors, for generating a current proportional to current passing through the current mirror to an output node; and, a second resistor, coupling between the output node and the first bipolar transistor, for generating a voltage proportional to the current from the means;

wherein the bipolar transistors are all of substantially the same size and the voltage on the output node is the output voltage from the bandgap voltage reference represented by the sum of the voltage across the second resistor and a voltage developed from the first bipolar transistor.

2. The bandgap voltage reference recited in claim 1, the means including cascode coupled FETs, responsive to the current mirror, for mirroring the current proportional to the current passing through the current mirror.

3. The bandgap voltage reference recited in claim 2, the voltage on the output node is substantially determined by:

$$V_T \times (R_{26}/R_{24}) \times M \times \ln(n \times (M+1));$$

wherein $V_T$ is the thermal voltage, $R_{24}$ and $R_{26}$ are the resistances of the first and second resistors, respectively, n is the number of bipolar transistors in the plurality of paralleled bipolar transistors and M is the ratio of the output current from the cascode coupled FETs to the current flowing in the current mirror.

4. The bandgap voltage reference recited in claim 3, the regulator means characterized by:

a first FET having the drain and gate terminals thereof coupling to the output of the current mirror; and a second FET, having substantially the same size as the first FET, the drain terminal coupling to the control current input of the current mirror and the gate terminal coupling to the gate terminals of the first FET;

wherein the source terminals of the first and second FETs are the outputs of the regulator means.

5. The bandgap voltage reference recited in claim 2, further characterized by:

a differential amplifier for sensing voltages at the control current input and the output of the current mirror; and, a variable voltage power source, with an output and responsive to the differential amplifier, for powering the bandgap voltage reference coupling to the output;

wherein the voltage of the power source varies in response to the differential amplifier to make the sensed voltages substantially equal.

6. The bandgap voltage reference recited in claim 5, the variable voltage power source being characterized by:

a current source coupling to the output; and, an FET, coupling to the output, for shunting current from the current source in response to the differential amplifier;

wherein the output voltage on the output of the variable voltage power source is regulated by the amount of current shunted by the FET.

7. A bandgap voltage reference providing an output voltage with a predetermined temperature coefficient and formed in an integrated circuit, having a thermal voltage reference, the thermal voltage reference including at least one current mirror and a regulator means, coupled to the current mirror, for providing at least two outputs with substantially the same voltage thereon. characterized by:

a differential amplifier for sensing voltages at the coupling between the current mirror and the regulator means; and, a variable voltage power source, responsive to the differential amplifier, for powering the bandgap voltage reference;

wherein the voltage from the variable voltage power source is varied in response to the differential amplifier until the sensed voltages are substantially equal.

8. The bandgap voltage reference recited in claim 7, the variable voltage power source being characterized by:

a current source coupling to the output; and, an FET, coupling to the output, for shunting current from the current source in response to the differential amplifier;

wherein the output voltage on the output of the variable voltage power source is regulated by the amount of current shunted by the FET.

9. A method of reducing the sensitivity of a bandgap voltage reference to variations in a power supply voltage, formed in an integrated circuit and having a thermal voltage reference, the thermal voltage reference including at least one current mirror and a regulator means coupled to the current mirror, for providing at least two outputs with substantially the same voltage thereon, characterized by the steps of:

sensing voltages at the coupling between the current mirror and the regulator means; and, varying the power supply voltage to at least the thermal voltage reference until the sensed voltages are substantially equal.

10. The method of reducing the sensitivity of a bandgap voltage reference recited in claim 9, the step of varying of the power supply voltage characterized by the steps of:

supplying a current to an output which powers at least the thermal voltage reference;

shunting the current from the output in response to the sensed voltages until the sensed voltages are substantially equal.

* * * * *